US008639162B2

(12) United States Patent
Tateishi

(10) Patent No.: US 8,639,162 B2
(45) Date of Patent: Jan. 28, 2014

(54) COLOR ELECTROPHOTOGRAPHIC IMAGE FORMING APPARATUS

(75) Inventor: Tomoya Tateishi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 106 days.

(21) Appl. No.: 13/111,164

(22) Filed: May 19, 2011

(65) Prior Publication Data

US 2011/0299881 A1 Dec. 8, 2011

(30) Foreign Application Priority Data

Jun. 2, 2010 (JP) ..... 2010-127020
May 6, 2011 (JP) ..... 2011-103374

(51) Int. Cl.
*G03G 21/00* (2006.01)

(52) U.S. Cl.
USPC ..... 399/124

(58) Field of Classification Search
USPC ..... 399/107, 110, 111, 113, 114, 122, 124
See application file for complete search history.

(56) References Cited

U.S. PATENT DOCUMENTS

| | | | | |
|---|---|---|---|---|
| 5,140,369 | A * | 8/1992 | Haneda et al. | 399/112 |
| 7,778,567 | B2 | 8/2010 | Igarashi et al. | |
| 7,890,019 | B2 | 2/2011 | Tateishi et al. | |
| 2006/0067734 | A1 | 3/2006 | Igarashi et al. | |
| 2008/0292355 | A1 | 11/2008 | Sakurai et al. | |
| 2009/0190955 | A1 | 7/2009 | Igarashi et al. | |
| 2009/0317127 | A1* | 12/2009 | Kishi | 399/110 |
| 2010/0080614 | A1 | 4/2010 | Yamaguchi et al. | |
| 2010/0080617 | A1 | 4/2010 | Noguchi | |
| 2010/0124432 | A1 | 5/2010 | Takayama | |
| 2010/0247143 | A1 | 9/2010 | Tateishi et al. | |

FOREIGN PATENT DOCUMENTS

| | | |
|---|---|---|
| CN | 101542398 | 9/2009 |
| CN | 101614997 | 12/2009 |
| JP | 2006-98772 | 4/2006 |

OTHER PUBLICATIONS

Search Report in European Patent Application No. 11167233.3, mailed Nov. 22, 2011.
Office Action in Chinese Patent Application No. 201110147065.5, dated Aug. 2, 2013 (with English-language translation).

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

A color electrophotographic image forming apparatus for forming an image on a recording material includes a cartridge supporting member for supporting a plurality of cartridges, wherein the cartridge supporting member is movable between an inside position inside a main assembly of the image forming apparatus and an outside position outside the main assembly and includes a plurality of mounting portions to which the plurality of cartridges are detachably mountable; and a conveying path along which the recording material is to be conveyed. The cartridge supporting member is movable to an exposing position, which is a part of the outside position, in which the conveying path is exposed at an upstream side of the upstreammost-side mounting portion with respect to a pulling-out direction in which the cartridge supporting member is to be moved from the inside position to the outside position.

20 Claims, 10 Drawing Sheets

COLOR ELECTROPHOTOGRAPHIC IMAGE FORMING APPARATUS

FIELD OF THE INVENTION AND RELATED ART

The present invention relates to an electrophotographic image forming apparatus, of an electrophotographic type or an electrostatic recording type, such as a copying machine or a printer.

In a conventional image forming apparatus such as a laser beam printer, it is mainstream that a latent image drawn on a photosensitive drum with laser light or the like is developed and a developed toner image is transferred onto a recording material (medium), and then the transferred toner image is fixed on the recording material. Further, as a process cartridge, a charging means, a developing means and an electrophotographic photosensitive member or the like are integrally assembled into a cartridge. This cartridge is detachably mountable to an image forming apparatus main assembly and can be exchanged by a user. Further, in order to facilitate maintenance, there is a type in which the cartridge is accommodated in a pulling-out member and is detachably mountable in a state in which the cartridge is pulled out toward the outside of the main assembly.

With respect to jam clearance in such an image forming apparatus, e.g., a constitution as described in Japanese Laid-Open Patent Application No. 2006-98772 has been known. This constitution is of the type in which the pulling-out member can be demounted from the main assembly and the jam clearance in the main assembly is effected from an open place.

However, in the above-described conventional constitution, there arose the following problem. When the jam clearance is effected, in order to separate the pulling-out member from the main assembly, there is a need to perform a pulling-out operation and re-mounting operation of the pulling-out member. Further, a space which was open to the inside of the main assembly was small for effecting the jam clearance without separating the pulling-out member from the main assembly, and therefore an improvement in jam clearance property has been desired.

SUMMARY OF THE INVENTION

The present invention has been accomplished in view of the above-described circumstances. A principal object of the present invention is to provide a color electrophotographic image forming apparatus having improved in operativity such as jam clearance.

According to an aspect of the present invention, there is provided a color electrophotographic image forming apparatus for forming an image on a recording material, comprising:

a cartridge supporting member for supporting a plurality of cartridges, wherein the cartridge supporting member is movable between an inside position inside a main assembly of the color electrophotographic image forming apparatus and an outside position outside the main assembly and includes a plurality of mounting portions to which the plurality of cartridges are detachably mountable; and a conveying path along which the recording material is to be conveyed, wherein the cartridge supporting member is movable to an exposing position, which is a part of the outside position, in which the conveying path is exposed at an upstream side of the upstreammost-side mounting portion with respect to a pulling-out direction in which the cartridge supporting member is to be moved from the inside position to the outside position.

These and other objects, features and advantages of the present invention will become more apparent upon a consideration of the following description of the preferred embodiments of the present invention taken in conjunction with the accompanying drawings.

Figure 5:
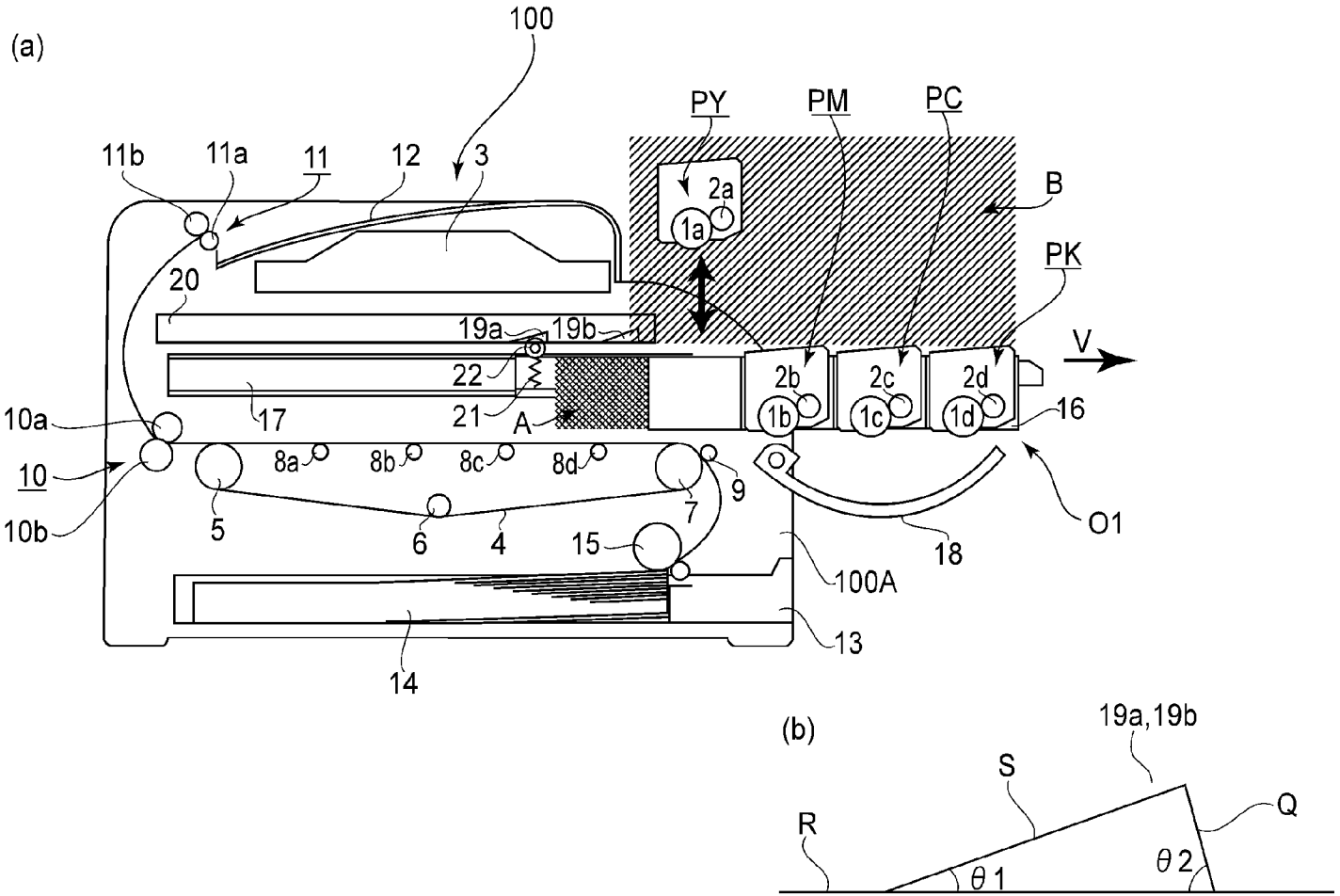

Parts (a) and (b) of FIG. 5 are sectional views showing a process cartridge exchange state in First Embodiment.

Figure 6:
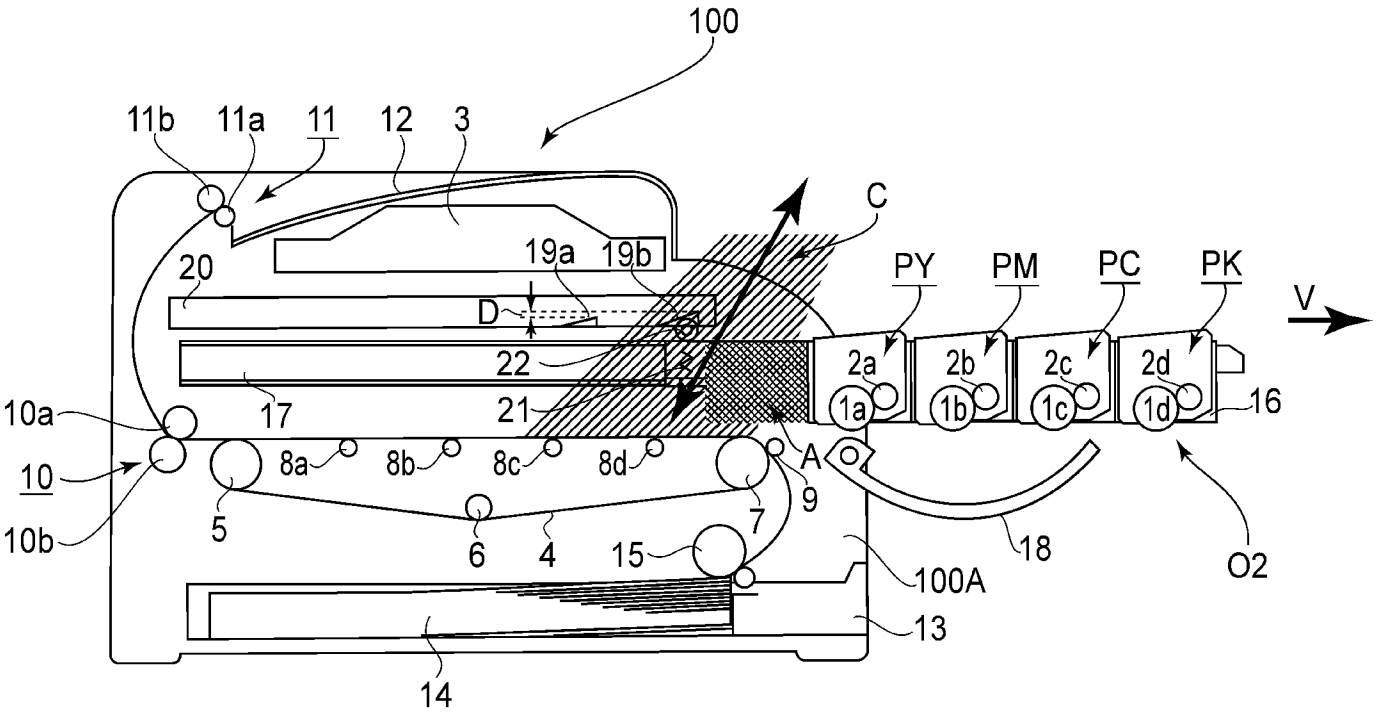

FIG. 6 is a sectional view showing a jam clearance state in First Embodiment.

Figure 7:
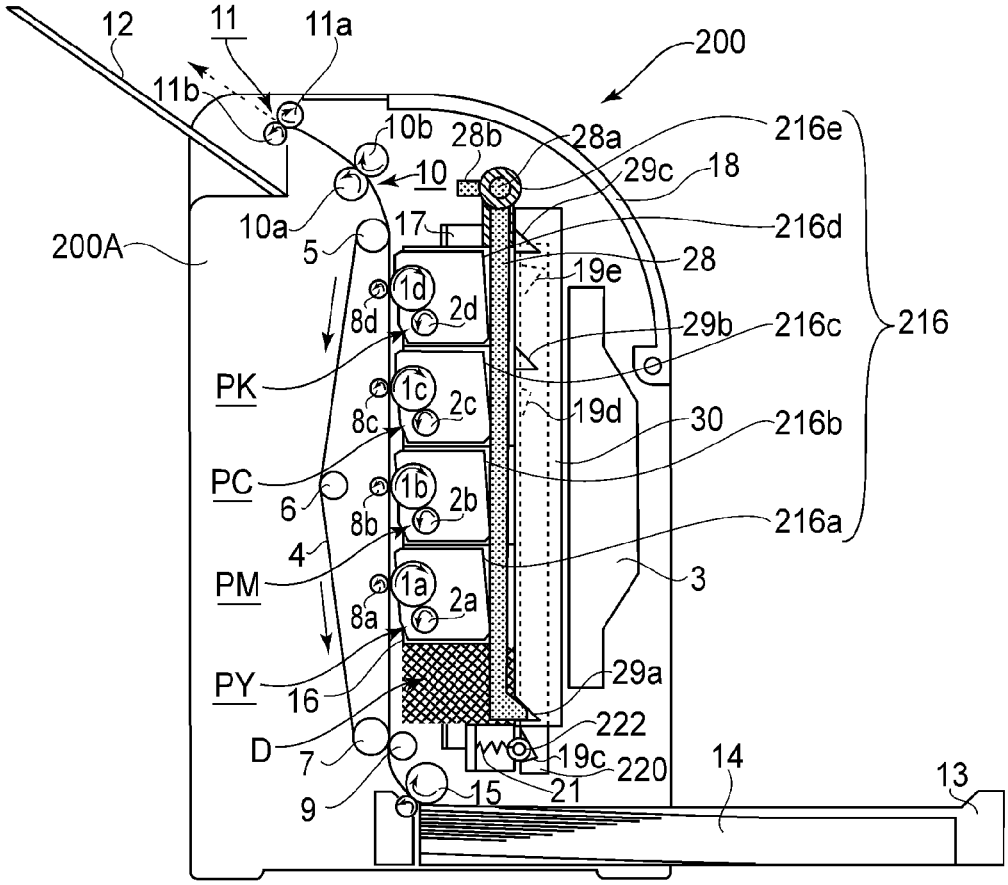

FIG. 7 is a sectional view showing a general structure of an image forming apparatus in Second Embodiment.

Figure 8:
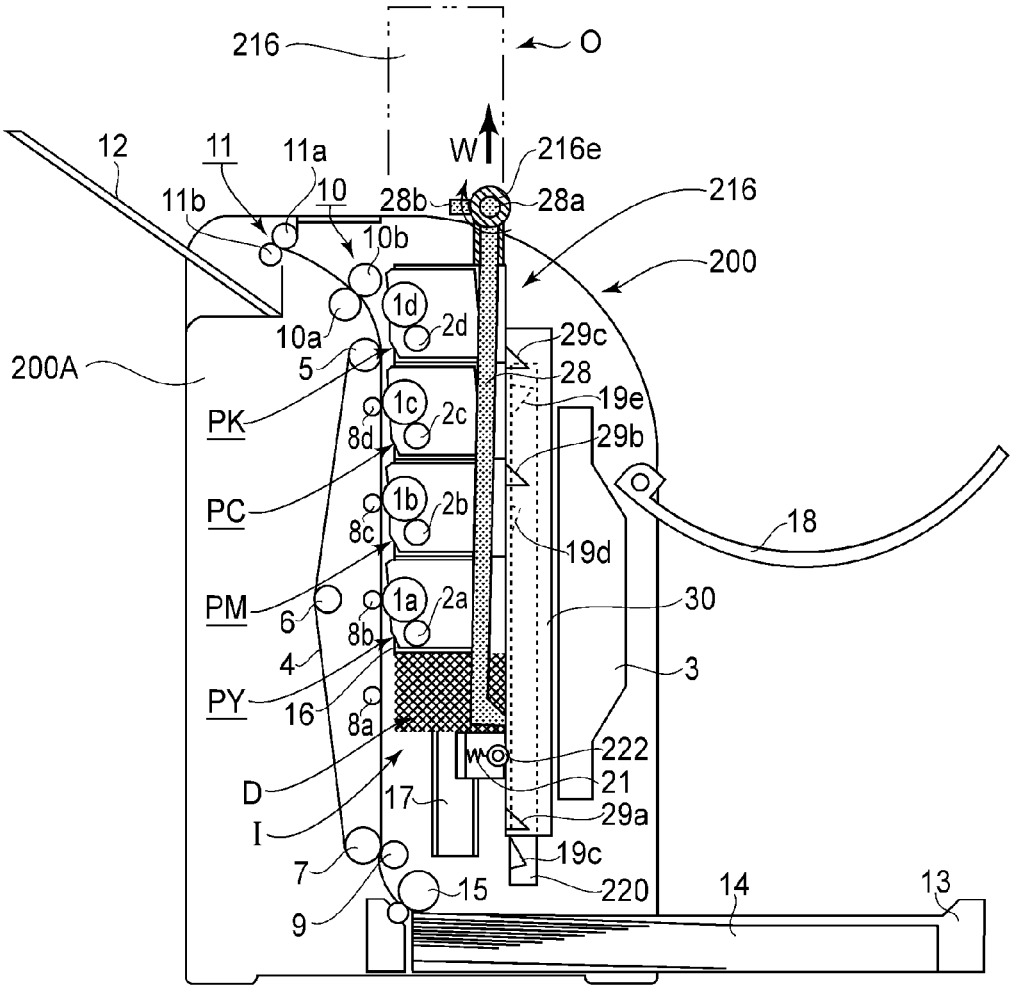

FIG. 8 is a sectional view showing a stopper release state in Second Embodiment.

Figure 9:
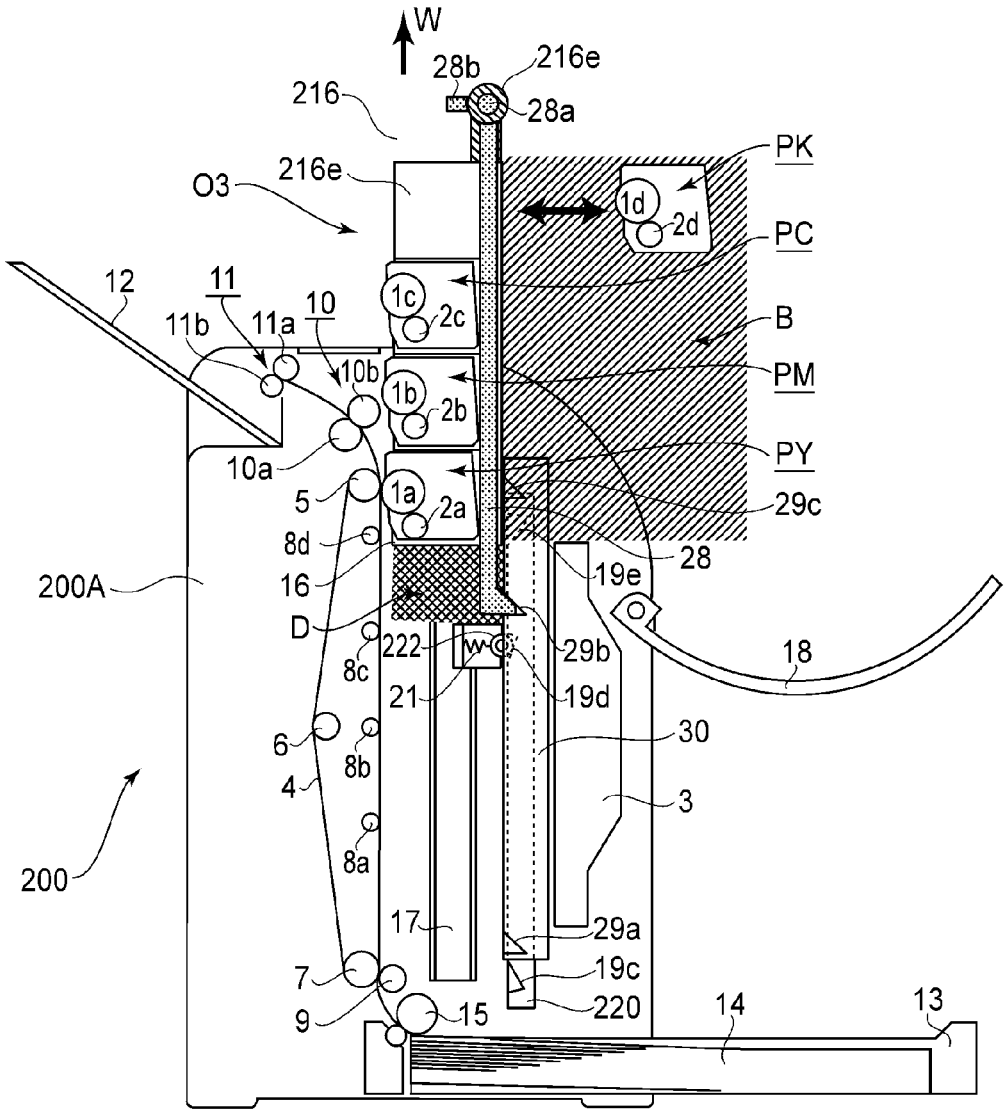

FIG. 9 is a sectional view showing a process cartridge exchange state in Second Embodiment.

Figure 10:
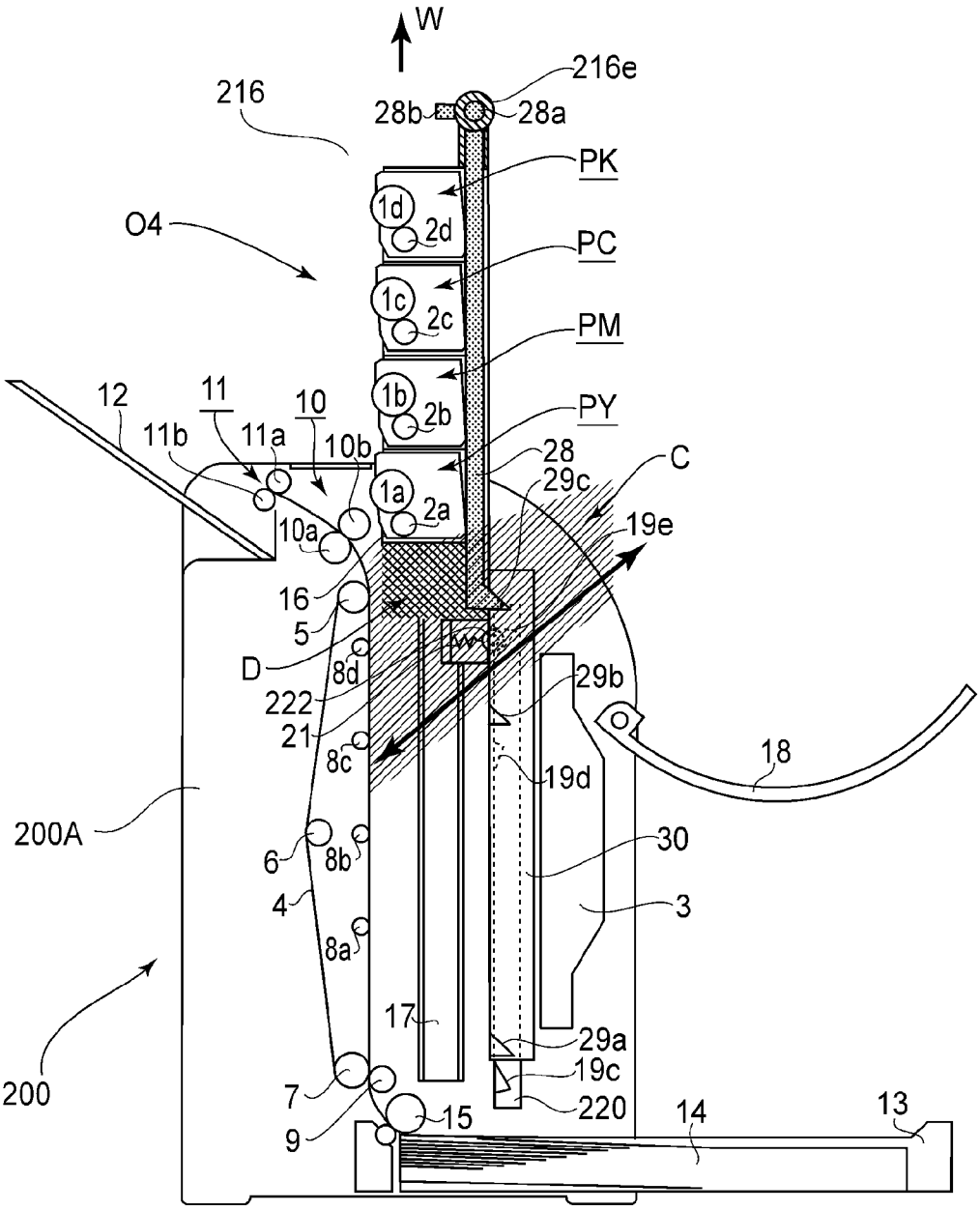

FIG. 10 is a sectional view showing a jam clearance state in Second Embodiment.

DESCRIPTION OF THE PREFERRED EMBODIMENTS

First Embodiment

A four color-based full-color electrophotographic image forming apparatus according to First Embodiment of the present invention will be described with reference to FIGS. 1 to 6.

(General Structure of Electrophotographic Image Forming Apparatus)

Figure 1:
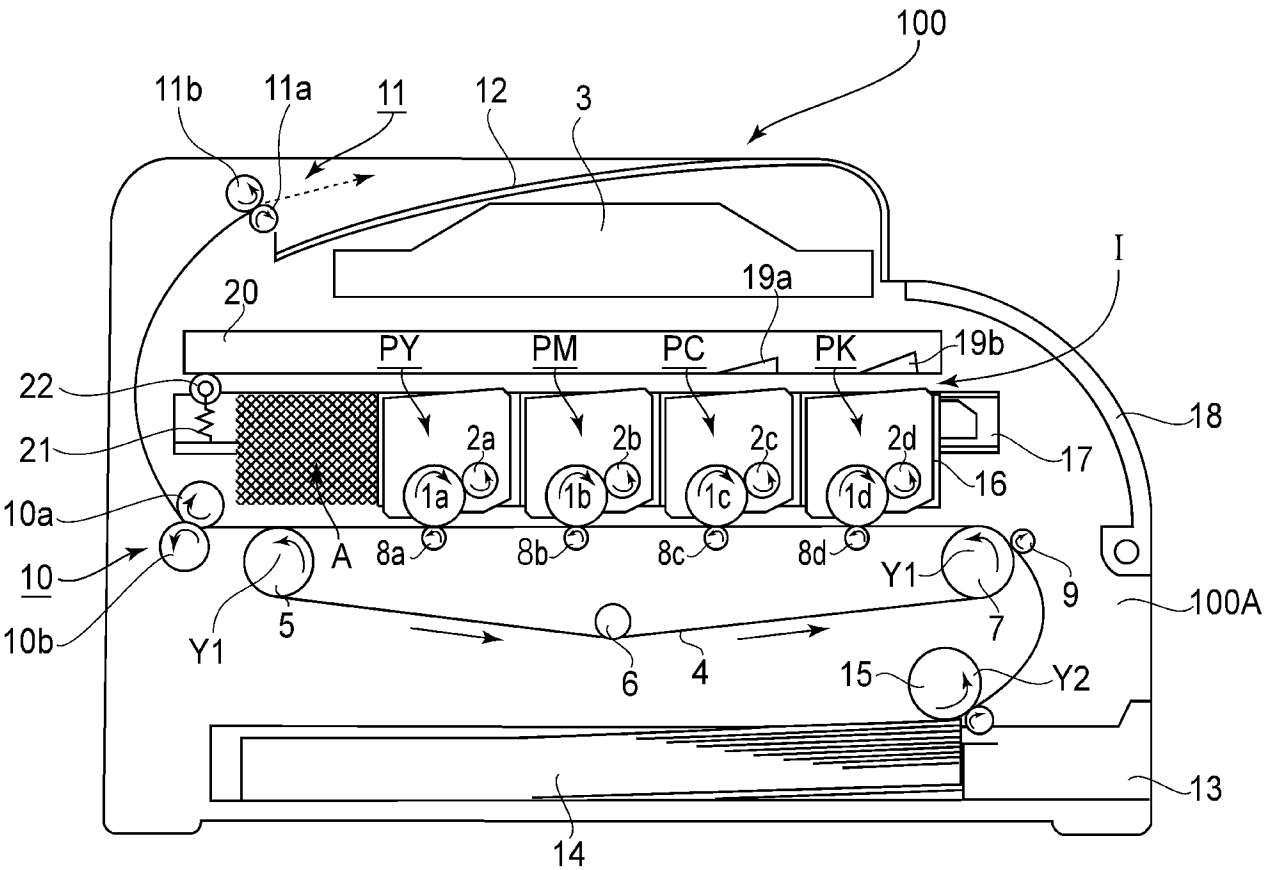
FIG. 1 is a sectional view showing a general structure of an image forming apparatus in First Embodiment.

First, general structure and function of a color electrophotographic image forming apparatus 100 according to this embodiment will be described. FIG. 1 is a sectional illustration showing the color electrophotographic image forming apparatus 100. In the following description, with respect to the image forming apparatus 100, a front side refers to a side at which an openable door 18 is disposed. A rear side refers to an opposite side from the front side. A front-rear direction refers to a direction (front direction) from the rear side toward the front side of the image forming apparatus 100 and a direction (rear direction) opposite from the front direction. Left and right refer to those as seen from the front side of the image forming apparatus 100. A left-right direction refers to a direction (left direction) from the right toward the left and a direction (right direction) opposite from the left direction.

The image forming apparatus 100 in this embodiment employs the type in which a toner image on a photosensitive drum 1 is directly transferred onto a recording material conveyed on a transfer conveyer belt 4. Incidentally, photosensitive drums 1*a*, 1*b*, 1*c* and 1*d* are collectively referred to as the photosensitive drum 1.

In an apparatus main assembly 100A of the image forming apparatus 100, from the rear side to the front side, four process cartridges PY, PM, PC and PK are mounted side by side in a substantially horizontal direction. The respective cartridges PY, PM, PC and PK are different in color of toner but have the same constitution. Incidentally, the cartridge PY contains a developer of yellow. Further, the cartridge PM contains a developer of magenta. Further, the cartridge PC contains a developer of cyan. Further, the cartridge PK contains a developer of black.

Each of the cartridges PY, PM, PC and PK (hereinafter referred to as a cartridge P) is prepared by integrally assembling the photosensitive drum 1 and a developing roller 2 or the like acting on the photosensitive drum 1 into the cartridge P. Above the cartridge P, a laser scanner unit 3 is disposed. This laser scanner unit 3 scanning-exposes the surface of the drum 1 of each cartridge with laser light to successively form an electrostatic latent image. Then, the electrostatic latent image is developed by the developing roller 2, so that a toner image is formed.

Under the cartridge P, the transfer conveyer belt 4 is disposed. This transfer conveyer belt 4 is stretched by three rollers consisting of a driving roller 5, a tension roller 6 and a follower roller 7 and is rotated in an arrow Y1 direction as shown in FIG. 1. Inside the transfer conveyer belt 4, four transfer rollers 8 (8*a*, 8*b*, 8*c*, 8*d*) are disposed opposed to the photosensitive drums of the respective cartridges P. At a position on an upstreammost side of the transfer conveyer belt 4 with respect to a conveyance direction of the transfer conveyer belt 4, an attraction roller 9 which opposes the follower roller 7 while sandwiching the transfer conveyer belt 4 therebetween. At the rear side of the image forming apparatus 100, a fixing device 10 and a discharging roller pair 11 are disposed. On an upper surface of the image forming apparatus 100, a discharge tray 12 is disposed. The fixing device 10 includes a fixing film 10*a* and a pressing roller 10*b*. The discharging roller pair 11 including discharging rollers 11*a* and 11*b*.

A recording material 14 stacked and accommodated in a feeding tray 13 is fed by a feeding roller 15 which is rotated in an arrow Y2 direction in FIG. 1 and thereafter is nipped between the attraction roller 9 and the transfer conveyer belt 4. At the same time, to the attraction roller 9, a bias voltage is applied. As a result, an electric field is formed between the attraction roller 9 and the follower roller 7, so that the transfer conveyer belt 4 and the recording material 14 therebetween are dielectric-polarized to cause an electrostatic attraction force between the transfer conveyer belt 4 and the recording material 14 and thus the recording material 14 is electrostatically attracted to the surface of the transfer conveyer belt 4. Onto the recording material 14 attracted to and carried on the transfer conveyer belt 4, by the rotation of the transfer conveyer belt 4, the respective color toner images formed on the photosensitive drums 1 of the respective image forming portions are successively transferred superposedly. Thereafter, the recording material 14 is separated from the transfer conveyer belt 4 and is set to a nip between the fixing film 10*a* and the pressing roller 10*b*. In the nip, the toner images are heated and pressed and are fixed on the recording material 14. The recording material 14 on which the toner images have been fixed is discharged on the discharge tray 12 by the discharging rollers 11*a* and 11*b*.

Figure 2:
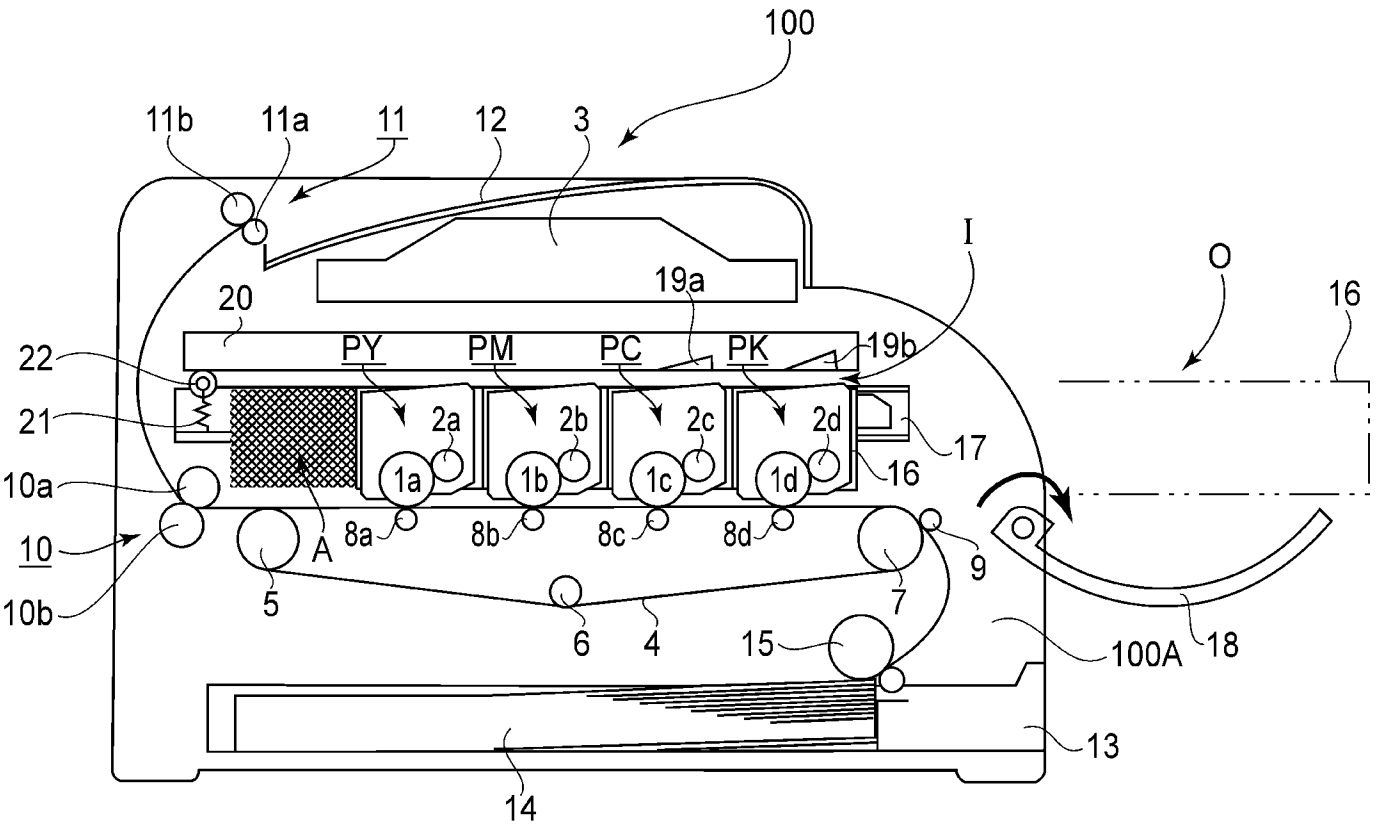
FIG. 2 is a sectional view for illustrating a state in which a cartridge tray can be pulled out in First Embodiment.
Figure 3:
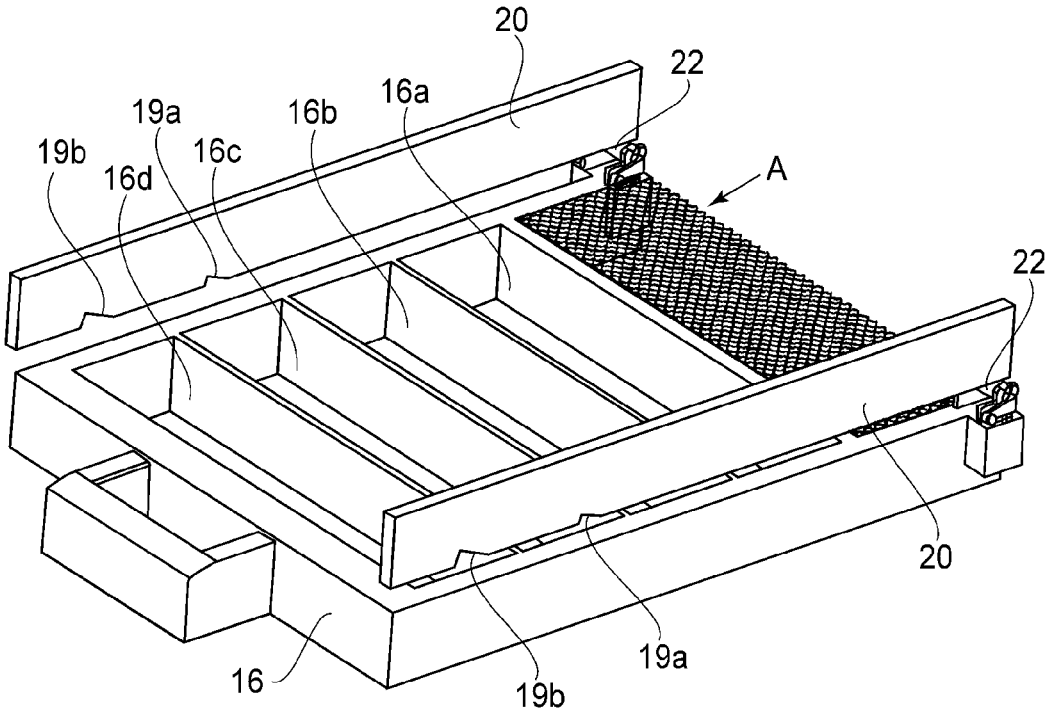
FIG. 3 is a perspective view showing an arrangement of the cartridge tray and an abutting member in First Embodiment.

FIG. 2 is a schematic view showing exchange of the cartridges P in this embodiment. In this embodiment, in order to improve usability, a type in which the cartridges P are accommodated in mounting portions 16*a*, 16*b*, 16*c* and 16*d* (FIG. 3) of a cartridge tray 16 (cartridge supporting member) and are exchanged in a front-access manner is employed. The cartridge tray 16 is supported with respect to the apparatus main assembly 100A by a rail member 17 and is provided slidably in the front-rear direction. The openable door 18 is provided rotatably relative to the apparatus main assembly 100A and FIG. 2 shows an open state of the openable door 18. When the openable door 18 is opened, in interrelation with its operation, the cartridges P are moved upward in a predetermined amount (distance). As a result, drive output portions (not shown) at the apparatus main assembly 100A side are disconnected from drive input portions (not shown) of the respective cartridges P. Further, the respective cartridges P are separated from positioning portions (not shown) provided in the apparatus main assembly 100A, so that the cartridge tray 16 can be pulled out from the apparatus main assembly 100A.

(Constitution of Cartridge Tray Portion)

Figure 4:
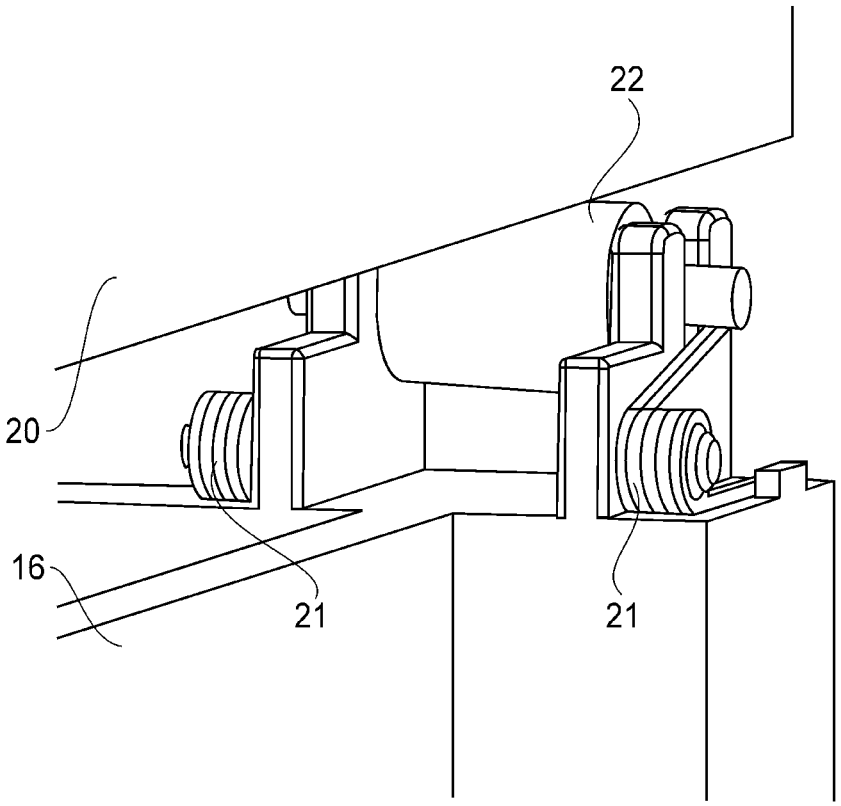
FIG. 4 is a perspective view showing an arrangement of an urging member, a rotatable member and the abutting member in First Embodiment.

Next, a pulling-out operation of the cartridge tray 16 and a jam clearance operation in this embodiment will be described. As shown in FIG. 11, on each of inner left and right side surfaces of the apparatus main assembly 100A, an abutting member 20 including a groove portion 19*a* (first engaging portion) and a groove portion 19*b* (second engaging portion) which constitute a recessed portion is disposed. Further, the cartridge tray 16 provided at its rear side with an opening A which is an area in which the cartridge P is not accommodated, and the opening (area) A has no bottom surface and no rear surface. As shown in FIG. 4, on each of rear left and right side surfaces of the cartridge tray 16, a rotatable member 22 urged against a lower surface of the abutting member 20 by an urging member 21 (elastic member) is disposed. That is, the rotatable member 22 is elastically urged by the urging member 21, thus being detachably engaged with the groove portions 19*a* and 19*b*. The lower surface of the abutting member 20 extends in the substantially horizontal direction with respect to the front-rear direction. Further, the urging by the urging member 21 is effected in a substantially vertical direction to the front-rear direction. The cartridge tray 16 is, as shown in FIGS. 1 and 2, movable between an inside position I located inside the apparatus main assembly 100A and an outside position O located outside the apparatus main assembly 100A. Incidentally, in this embodiment, the abutting member 20 is disposed on the inner left and right side surfaces of the apparatus main assembly 100A but may also be disposed at plural positions. Further, the abutting member 20 may be disposed at any position with respect to the left-right direction.

When the cartridge tray 16 is pulled out in the front direction, as shown in (a) of FIG. 5, the rotatable member 22 (urging member) is engaged with held in the groove portion 19*a*. A position (first position) of the cartridge tray 16 at this time is a mounting and demounting position O1, which is a part of the outside position O, in which the cartridge P is detachably mountable in an upper surface open area B. That is, at this position, the cartridges from the cartridge PK to the cartridge PY mounted upstreammost of the cartridge tray 16 with respect to a movement direction (pulling-out direction V) in which the cartridge P is moved from the inside position I to the outside position O are detachable mountable. Incidentally, at this mounting and demounting position O1, the transfer conveyer belt 4 which is a conveying path of the recording material is not exposed.

The abutting member 20 includes the groove portion 19*b* closer to the front side than the groove portion 19*a* with which the rotatable member 20 is engaged. For that reason, as shown in FIG. 6, at a position (second position) in which the rotatable member 22 is to be engaged with the groove portion 19*b*, the cartridge tray 16 can be held and at this time, an area C constitutes an open area to the inside of the apparatus main assembly 100A, so that the transfer conveyer belt 4 which is the conveying path of the recording material is exposed. In this embodiment, this position is an exposing position O2 which is a part of the outside position O. Therefore, when the recording material 14 is stagnated on the transfer conveyer belt 4, the user can access the inside of the apparatus main assembly 100A in order to remove the recording material 14 without detaching the toner 16 from the apparatus main assembly 100A. Thus, operativity such as jam clearance is improved.

Further, the groove portion 19*b* is set in a deeper groove shape than the groove portion 19*a* by a distance D as shown in FIG. 6. For that reason, a force required when the rotatable member 22 is escaped from the groove portion 19*b* becomes large, so that it is possible to suppress erroneous removal of the cartridge tray 16 from the apparatus main assembly 100A by the user.

Further, as shown in (b) of FIG. 5, each of the groove portions 19*a* and 19*b* is constituted by a first surface S to which the rotatable member 22 is to be contacted in an entering process and a second surface Q to which the rotatable member 22 is to be contacted in an escaping process. Further, an angle θ1 formed between the first surface S and a lower surface R of the abutting member 20 is set at a value smaller than that of an angle θ2 formed between the second surface Q and the lower surface R. For that reason, a load for permitting an escape of the rotatable member 22 from the groove portion 19*b* with respect to the pulling-out direction V is larger than a load for permitting an escape of the rotatable member 22 from the groove portion 19*a* with respect to a pushing-in direction opposite from the pulling-out direction V. Therefore, when the cartridge tray 16 is pulled out from the apparatus main assembly 100A to the mounting and demounting position O1 or the exposing position O2, every engagement of the rotatable member 22 with the groove portion 19*a* or 19*b*, the user feels click feeling. However, when the cartridge tray 16 is pushed into the apparatus main assembly 100A from the exposing position O2 or the mounting and demounting position O1, a load when the rotatable member 22 is escaped from the groove portion 19 is smaller than a load when the rotatable member 22 is pulled out. Therefore, the user can smoothly push the cartridge tray 16 into the apparatus main assembly 100A.

Incidentally, in the above description, the groove portions 19*a* and 19*b* are provided to the apparatus main assembly 100A and the rotatable member 22 is provided to the cartridge tray 16. However, the rotatable member 22 may also be provided to the apparatus main assembly 100A and the groove portions 19*a* and 19*b* may also be provided to the cartridge tray 16. That is, the groove portions 19*a* and 19*b* may be provided to either one of the apparatus main assembly 100A and the cartridge tray 16, and the rotatable member 22 may be provided to the other one of the apparatus main assembly 100A and the cartridge tray 16. Further, in this embodiment, the exposing position O2 was the position in which the transfer conveyer belt 4 which was the conveying path of the recording material was exposed. However, the conveying path is not the transfer conveyer belt 4 but may also be simply a conveying guide for conveying the recording material.

Second Embodiment

A color electrophotographic image forming apparatus in Second Embodiment will be described with reference to FIGS. 7 to 10. FIG. 7 shows a structure of an image forming apparatus 200 in this embodiment. The description will be made below based on this figure but the procedure of the image formation is similar to that in First Embodiment. Portions or means for which description of constitution and function overlap with that for associated portions or means in First Embodiment are represented by the same reference numerals or symbols and will be omitted from the description.

In this embodiment, a cartridge tray 216 in which the cartridges PY, PM, PC and PK are mounted adjacently to each other in a substantially vertical direction is capable of being pulled out relative to the disposing surface of the image forming apparatus 200 with respect to the substantially vertical direction. The cartridge tray 216 is supported by a rail member 217 so as to be capable of being pulled out. Further, the cartridge tray 216 includes mounting portions 216*a*, 216*b*, 216*c* and 216*d* in which the cartridges PY, PM, PC and PK are to be detachably mounted. Further, on an upper surface of the cartridge tray 216, a grip portion 216*e* for pulling out the cartridge tray 216 to the outside of an apparatus main assembly 200A. At a side surface of the grip portion 216*e*, a stopper 28 is disposed in order to prevent drop of the cartridge tray 216 by the self-weight of the cartridge tray 216. The stopper 28 is rotatable, relative to the grip portion 216*e*, about a supporting portion 28*a* and is urged in the counterclockwise direction (not shown). Further, an abutting member 220 including groove portions 19*c*, 19*d* and 19*e* is disposed at an inner side surface of the apparatus main assembly 200A, and a preventing member 30 including preventing grooves 29*a*, 29*b* and 29*c* which are engageable with the stopper 28 is disposed at an inner left side surface of the apparatus main assembly 200A. In FIG. 7, a rotatable member 222 is engaged with the groove portion 19*c* of the abutting member and the stopper 28 is engaged with the preventing groove 29*a* of the preventing member 30, so that the cartridge tray 216 is held at a position in which the image formation is to be effected.

When the cartridge tray 216 is removed, the user grips the grip portion 216*e* and pulls out the cartridge tray 216 in an upward direction W which is the pulling-out direction but at this time, the stopper 28 is disconnected from the preventing groove 29*a* by clockwise rotating a projected portion 28*b*. FIG. 8 shows a disconnected state of the stopper 28 in a pulling-out process. In this state, by pulling out the cartridge tray 216, the rotatable member 222 is engaged with the groove portion 19*d* as shown in FIG. 9, so that the user can recognize a mounting and demounting position O3 in which the cartridge P is detachably mountable. Then, the grip portion 216*e* and the projected portion 28*b* are separated, so that the stopper 28 is engaged with the preventing groove 29*b*. As a result, the drop of the cartridge tray 216 by the self-weight of the cartridge tray 216 is prevented and the cartridge tray 216 is held at the mounting and demounting position O3 of the cartridge P, so that the cartridge P can be demounted and mounted in a front open area B. Incidentally, similarly as in First Embodiment, at the mounting and demounting position O3, the transfer conveyer belt 4 which is the conveying path of the recording material is not exposed. The abutting member 220 includes the groove portion 19*e* located above the groove portion 19*d* with which the rotatable member 222 is engaged. For that reason, as shown in FIG. 10, the cartridge tray 216 can be held at an exposing position O4 in which the rotatable member 222 is engaged with the groove portion 19*e* and the stopper 228 is engaged with the preventing groove 29*c*. At this time, the user can access the transfer conveyer belt 4, which is the conveying path and is provided inside the apparatus main assembly 200A, through an opening D provided upstream of the upstreammost mounting portion 216*a* of the cartridge tray 216 with respect to a pulling-out direction W. That is, the transfer conveyer belt 4 is exposed through an area C, so that operativity such as the jam clearance when the recording material 14 is stagnated on the transfer conveyer belt 4 is improved.

When the cartridge tray 216 is accommodated inside the apparatus main assembly 200A, the stopper 28 is disconnected by clockwise rotating the projected portion 28*b*, so that the cartridge tray 216 is moved in a downward direction which is the opposite direction from the pulling-out direction W. Further, at a position in which the rotatable member 222 is engaged with the groove portion 19*c*, the grip portion 216*e* and the projected portion 28*b* are separated, so that the stopper 18 is engaged with the preventing groove 29*a* and the cartridge tray 216 is held at the inside position I in which the image formation is to be effected. Incidentally, in order to alleviate a drop speed of the cartridge tray 216 by the self-weight of the cartridge tray 216, a damper or the like may also be used.

As described above, according to the present invention, the cartridge supporting member can be moved to the exposing position in which the conveying path along which the recording material is conveyed is exposed and therefore it is possible to effect the jam clearance without removing the cartridge supporting member from the apparatus main assembly.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 127020/2010 filed Jun. 2, 2010 and 103374/2011 filed May 6, 2011, which are hereby incorporated by reference.

What is claimed is:

1. A color electrophotographic image forming apparatus for forming an image on a recording material, the apparatus comprising:

a cartridge supporting member for supporting a plurality of cartridges, wherein said cartridge supporting member (i) is movable between an inside position inside a main assembly of said color electrophotographic image forming apparatus and an outside position outside the main assembly and (ii) includes a plurality of mounting portions to which the plurality of cartridges are detachably mountable; and a conveying path along which the recording material is to be conveyed, wherein said cartridge supporting member is movable to an exposing position, which is a part of the outside position, in which said conveying path is exposed at an upstream side of the upstreammost-side mounting portion with respect to a pulling-out direction in which said cartridge supporting member is moved from the inside position to the outside position, and wherein, when the recording material is stagnated in the conveying path, by positioning said cartridge supporting member at the exposing position, the stagnated recording material is removable from the upstream side of the upstreammost-side mounting portion with respect to the pulling-out direction without demounting a cartridge of the plurality of cartridges from said cartridge supporting member mounted at the upstreammost-side mounting portion.

2. A color electrophotographic image forming apparatus according to claim 1, wherein said cartridge supporting member is provided with an opening through which said conveying path is capable of being exposed at the exposing position and through which the stagnated recording material is removable when said cartridge supporting member is at the exposing position.

3. A color electrophotographic image forming apparatus according to claim 1, further comprising:

a first engaging portion that is provided on one of said cartridge supporting member and the main assembly in order to hold said cartridge supporting member at a mounting and demounting position, the mounting and demounting position being a part of the outside position, in which said conveying path is not exposed; and an urging member provided on the other one of said cartridge supporting member and the main assembly in order to be demountably engaged with said first engaging portion by being elastically urged.

4. A color electrophotographic image forming apparatus according to claim 3, further comprising a second engaging portion, which is provided on either one of said cartridge supporting member and the main assembly and is engageable with said urging member, for holding said cartridge supporting member when said cartridge supporting member is moved to the exposing position.

5. A color electrophotographic image forming apparatus according to claim 4, wherein a load required when said cartridge supporting member is moved in the pulling-out direction in a state in which said urging member is engaged with said second engaging portion is larger than a load required when said cartridge supporting member is moved in the pulling-out direction in a state in which said urging member is engaged with said first engaging portion.

6. A color electrophotographic image forming apparatus according to claim 4, wherein each of said first engaging portion and said second engaging portion is a recessed portion, and said recessed portion of said second engaging portion is deeper than said recessed portion of said first engaging portion.

7. A color electrophotographic image forming apparatus according to claim 3, wherein said urging member is a rotatable member which is elastically urged toward said first engaging portion by an elastic member and which is rotated about an axis.

8. A color electrophotographic image forming apparatus according to claim 4, wherein each of said first engaging portion and said second engaging portion is a recessed portion having (i) a first surface to which said urging member is contacted in a process in which said urging member enters said recessed portion when said cartridge supporting member is moved in the pulling-out direction and (ii) a second surface to which said urging member is contacted in a process in which said urging member is escaped from said recessed portion when said cartridge supporting member is moved in the pulling-out direction, and wherein an angle θ1 formed between said first surface and the pulling-out direction is smaller than an angle θ2 formed between said second surface and the pulling-out direction.

9. A color electrophotographic image forming apparatus according to claim 1, wherein said cartridge supporting member is movable in a horizontal direction or in a vertical direction with respect to a disposing surface on which said color electrophotographic image forming apparatus is disposed.

10. A color electrophotographic image forming apparatus according to claim 1, wherein said conveying path is a conveyer belt for conveying the recording material.

11. An image forming apparatus for forming an image on a recording material, the apparatus comprising:

a cartridge supporting member for supporting a cartridge, wherein said cartridge supporting member (i) is movable between a first position inside a main assembly of said image forming apparatus and a second position outside the main assembly, with said cartridge supporting member being connected to the main assembly when positioned at the exposing position, and (ii) includes a mounting portion to which the cartridge is detachably mountable; and a conveying path along which the recording material is to be conveyed, wherein in the second position, said conveying path is exposed at an upstream side of the mounting portion with respect to a pulling out direction in which said cartridge supporting member is moved from the first position to the second position, and wherein, when the recording material is stagnated in the conveying path, by positioning said cartridge supporting member at the second position, the stagnated recording material is removable from the upstream side of the mounting portion with respect to the pulling out direction without demounting the cartridge from said cartridge supporting member mounted at the mounting portion.

12. An image forming apparatus according to claim 11, wherein said cartridge supporting member is provided with an opening through which said conveying path is capable of being exposed at the second position and through which the stagnated recording material is removable when said cartridge supporting member is at the second position.

13. An image forming apparatus according to claim 11, further comprising a first engaging portion, which is provided on one of said cartridge supporting member and the main assembly, and which is engageable with an urging member for holding said cartridge supporting member when said cartridge supporting member is moved to the second position.

14. An image forming apparatus according to claim 13, wherein said urging member is a rotatable member that is elastically urged toward said first engaging portion by an elastic member and which is rotated about an axis.

15. An image forming apparatus according to claim 13, further comprising a second engaging portion, which is provided on either one of said cartridge supporting member and the main assembly and is engageable with said urging member, for holding said cartridge supporting member when said cartridge supporting member is moved to the second position, wherein each of said first engaging portion and said second engaging portion is a recessed portion having (i) a first surface to which said urging member is contacted in a process in which said urging member enters said recessed portion when said cartridge supporting member is moved in the pulling out direction and (ii) having a second surface to which said urging member is contacted in a process in which said urging member is escaped from said recessed portion when said cartridge supporting member is moved in the pulling out direction, and wherein an angle $\theta 1$ formed between said first surface and the pulling out direction is smaller than an angle $\theta 2$ formed between said second surface and the pulling out direction.

16. An image forming apparatus according to claim 11, wherein said cartridge supporting member is movable in a horizontal direction or in a vertical direction with respect to a disposing surface on which said image forming apparatus is disposed.

17. An image forming apparatus according to claim 11, wherein said conveying path is a conveyer belt for conveying the recording material.

18. An image forming apparatus according to claim 11, further comprising a rail member for movably supporting said cartridge supporting member between the first position and the second position.

19. An image forming apparatus according to claim 11, wherein the cartridge includes a developer accommodating portion for accommodating a developer.

20. An image forming apparatus according to claim 11, wherein said conveying path is a conveying guide for conveying the recording material.

* * * * *